US011848492B2

(12) United States Patent
Semonov et al.

(10) Patent No.: US 11,848,492 B2
(45) Date of Patent: Dec. 19, 2023

(54) LOW BAND DIPOLE AND MULTI-BAND MULTI-PORT ANTENNA ARRANGEMENT

(71) Applicant: Nokia Shanghai Bell Co., Ltd., Shanghai (CN)

(72) Inventors: Kostyantyn Semonov, Wallingford, CT (US); Chengyu Xu, Shanghai (CN); Yaohuan Li, Shanghai (CN)

(73) Assignee: RFS Technologies, Inc., Meriden, CT (US)

( * ) Notice: Subject to any disclaimer, the term of this patent is extended or adjusted under 35 U.S.C. 154(b) by 649 days.

(21) Appl. No.: 16/060,545

(22) PCT Filed: Dec. 2, 2016

(86) PCT No.: PCT/CN2016/108408

§ 371 (c)(1),
(2) Date: Jun. 8, 2018

(87) PCT Pub. No.: WO2017/097164

PCT Pub. Date: Jun. 15, 2017

(65) Prior Publication Data

US 2018/0358692 A1 Dec. 13, 2018

(30) Foreign Application Priority Data

Dec. 10, 2015 (CN) ..... 201510919997.5

(51) Int. Cl.
*H01Q 21/26* (2006.01)
*H01Q 1/52* (2006.01)
(Continued)

(52) U.S. Cl.
CPC ..... *H01Q 1/521* (2013.01); *H01Q 1/246* (2013.01); *H01Q 1/36* (2013.01); *H01Q 5/48* (2015.01);
(Continued)

(58) Field of Classification Search
CPC ..... H01Q 1/521; H01Q 5/48; H01Q 9/44; H01Q 21/24; H01Q 21/26; H01Q 9/285; H01Q 21/00
See application file for complete search history.

(56) References Cited

U.S. PATENT DOCUMENTS 2,505,098 A * 4/1950 Cornelius ..... H01Q 13/10 343/803
2,648,768 A 8/1953 Woodward
(Continued)

FOREIGN PATENT DOCUMENTS

CN 1886864 A 12/2006
CN 201018000 Y 2/2008
(Continued)

OTHER PUBLICATIONS

International Search Report for PCT/CN2016/108408 dated Feb. 14, 2017.
(Continued)

*Primary Examiner* — Hasan Islam
(74) *Attorney, Agent, or Firm* — Wolf, Greenfield & Sacks, P.C.

(57) ABSTRACT

A low band dipole and a multi-band multi-port antenna arrangement are disclosed. The low band dipole has four dipole arms. The four dipole arms are horizontally and mutually perpendicularly placed in a "+" shape and adjacent two mutually perpendicular dipole arms are fed therebetween. The antenna arrangement includes a main reflector, at least one column of low band dipole array disposed on the main reflector, and at least one column of high band dipole array adjacent to the at least one column of the low band dipole array. At least one low band dipole in each column of the at least one column of low band dipole array satisfies the following condition: the low band dipole has four dipole arms, the four dipole arms are horizontally and mutually
(Continued)

perpendicularly placed in a "+" shape, and adjacent two mutually perpendicular dipole arms are fed therebetween to form a +/−45 degree polarization.

15 Claims, 5 Drawing Sheets

(51) Int. Cl.

| | |
|---|---|
| ***H01Q 1/24*** | (2006.01) |
| ***H01Q 9/28*** | (2006.01) |
| ***H01Q 5/48*** | (2015.01) |
| ***H01Q 21/08*** | (2006.01) |
| ***H01Q 19/10*** | (2006.01) |
| ***H01Q 21/28*** | (2006.01) |
| ***H01Q 21/24*** | (2006.01) |
| ***H01Q 1/36*** | (2006.01) |
| ***H01Q 9/44*** | (2006.01) |
| ***H01Q 15/14*** | (2006.01) |

(52) U.S. Cl.
CPC ..... *H01Q 9/28* (2013.01); *H01Q 9/44* (2013.01); *H01Q 15/14* (2013.01); *H01Q 19/108* (2013.01); *H01Q 21/08* (2013.01); *H01Q 21/24* (2013.01); *H01Q 21/26* (2013.01); *H01Q 21/28* (2013.01)

(56) References Cited

U.S. PATENT DOCUMENTS

| | | | | |
|---|---|---|---|---|
| 5,481,272 | A * | 1/1996 | Yarsunas | H01Q 21/26 343/789 |
| 5,818,397 | A * | 10/1998 | Yarsunas | H01Q 1/246 343/789 |
| 7,079,079 | B2 * | 7/2006 | Jo | H01Q 1/243 343/700 MS |
| 7,804,460 | B2 * | 9/2010 | Lee | H01Q 9/26 343/810 |
| 8,350,776 | B1 * | 1/2013 | Bauman | H01Q 7/005 343/893 |
| 8,786,511 | B1 * | 7/2014 | Dao | H01Q 21/26 343/793 |
| 9,276,323 | B2 * | 3/2016 | Moon | H01Q 5/42 |
| 10,389,018 | B2 * | 8/2019 | Daojian | H01Q 21/26 |
| 10,707,563 | B2 * | 7/2020 | So | H01Q 21/26 |
| 2005/0253769 | A1 * | 11/2005 | Timofeev | H01Q 1/246 343/797 |
| 2008/0074339 | A1 * | 3/2008 | Lee | H01Q 9/26 343/803 |
| 2010/0149062 | A1 | 6/2010 | Baldauf | |
| 2011/0241972 | A1 * | 10/2011 | Wansch | H01Q 1/27 343/893 |
| 2012/0235873 | A1 | 9/2012 | Wu | |
| 2014/0111396 | A1 * | 4/2014 | Hyjazie | H01Q 21/26 343/893 |
| 2014/0139387 | A1 * | 5/2014 | Jones | H01Q 19/30 343/794 |
| 2014/0191918 | A1 | 7/2014 | Cheng et al. | |
| 2014/0236546 | A1 | 8/2014 | Payne | |
| 2015/0162665 | A1 * | 6/2015 | Boryssenko | H01Q 1/48 343/797 |
| 2015/0263435 | A1 | 9/2015 | Song | |
| 2016/0248166 | A1 | 8/2016 | Moon et al. | |
| 2016/0365645 | A1 * | 12/2016 | Bisiules | H01Q 21/0006 |

FOREIGN PATENT DOCUMENTS

| | | | | |
|---|---|---|---|---|
| CN | 102683825 | A | 9/2012 | |
| CN | 102800929 | A | 11/2012 | |
| CN | 103181028 | A | 6/2013 | |
| CN | 103311651 | A | 9/2013 | |
| CN | 103311652 | A | 9/2013 | |
| CN | 203660065 | U | 6/2014 | |
| CN | 203840254 | A | 6/2014 | |
| CN | 103904438 | A | 7/2014 | |
| CN | 103915678 | A | 7/2014 | |
| CN | 203871476 | U | 10/2014 | |
| CN | 203932313 | U | 11/2014 | |
| CN | 104269649 | A | 1/2015 | |
| CN | 104916910 | A | 9/2015 | |
| CN | 204857945 | U | 12/2015 | |
| CN | 205564979 | U | 9/2016 | |
| EP | 02769476 | | 8/2014 | |
| EP | 3349304 | A1 | 7/2018 | |
| FR | 02863111 | | 6/2005 | |
| JP | H06-338718 | A | 12/1994 | |
| JP | 2009124403 | A | 6/2009 | |
| JP | 2012156969 | A * | 8/2012 | H01Q 21/24 |
| JP | 2013501461 | A | 1/2013 | |
| JP | 2017508402 | A | 3/2017 | |
| KR | 2008028003 | A | 3/2008 | |
| WO | WO 2012065420 | A1 | 5/2012 | |
| WO | WO 2014/070890 | A1 | 5/2014 | |
| WO | 2014100938 | | 7/2014 | |
| WO | WO-2014100938 | A1 * | 7/2014 | H01Q 1/246 |
| WO | 2015/068981 | | 5/2015 | |
| WO | WO 2015/142743 | A1 | 9/2015 | |

OTHER PUBLICATIONS

English Bibliograph for Korean Patent Application No. KR2008028003A, published on Mar. 31, 2008, printed from Derwent Innovation on Apr. 27, 2020, 6 pages.

PCT Patent Application No. PCT/CN2016/108408, Written Opinion of the International Searching Authority, dated Feb. 14, 2017, 7 pages.

Extended European Search Report of European Application No. 16872355.9, dated Jul. 1, 2019, 9 pages.

English Bibliography of PCT Pat. App. Publication No. WO2015068981A1, Published on May 14, 2015, Printed from Derwent Innovations on May 7, 2020, 5 pages.

English Bibliography of Japanese Patent Application No. JP2009124403A, published on Jun. 4, 2009, printed from Derwent Innovation on Feb. 24, 2021, 6 pages.

English Bibliography of Japanese Patent Application No. JP2013501461A, published on Jan. 10, 2013, printed from Derwent Innovation on Feb. 24, 2021, 6 pages.

English Bibliography of Japanese Patent Application No. JP2017508402A, published on Mar. 23, 2017, printed from Derwent Innovation on Feb. 24, 2021, 6 pages.

English Bibliography of Japanese Patent Application No. JPH06-338718A, published on Dec. 6, 1994, printed from Derwent Innovation on Oct. 15, 2021, 4 pages.

Ivana Radnovic, A New Type of Turnstile Antenna, IEEE Antennas and Propagation Magazine, Oct. 2010, 168-171, vol. 52 No. 5.

* cited by examiner

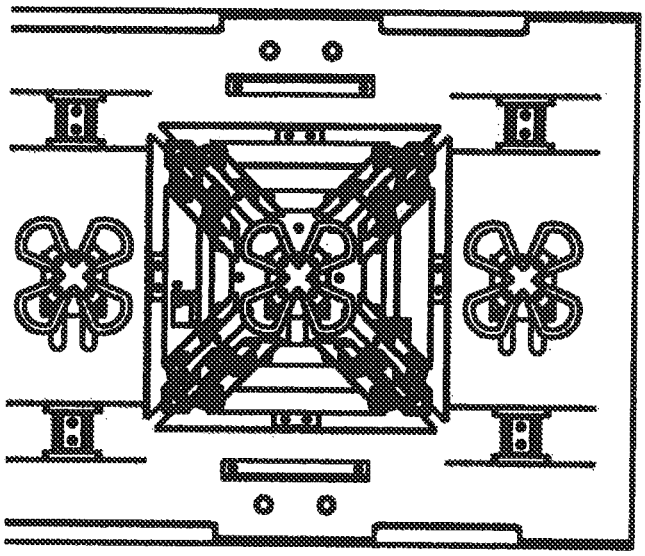
Figure 1-a
(PRIOR ART)
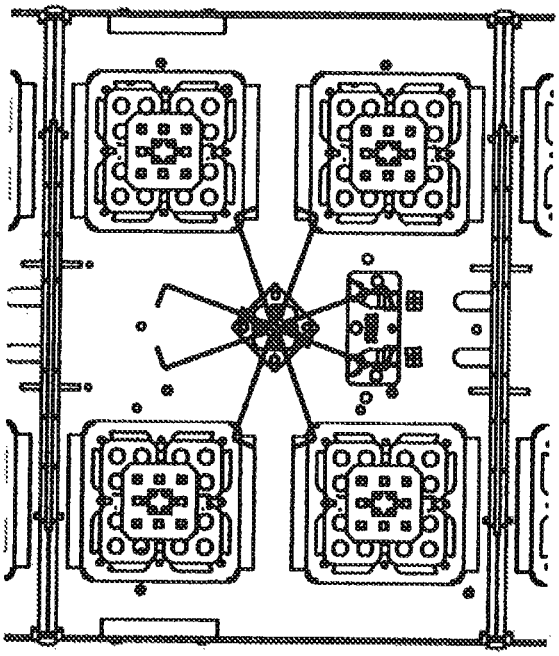
Figure 1-b
(PRIOR ART)

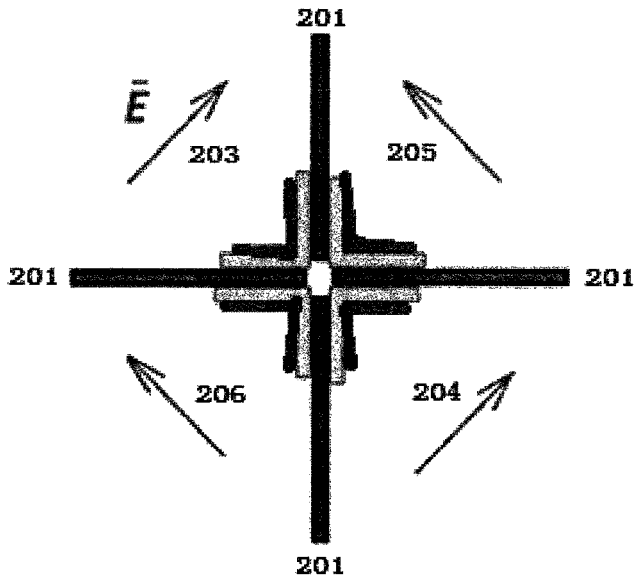
Figure 2-a
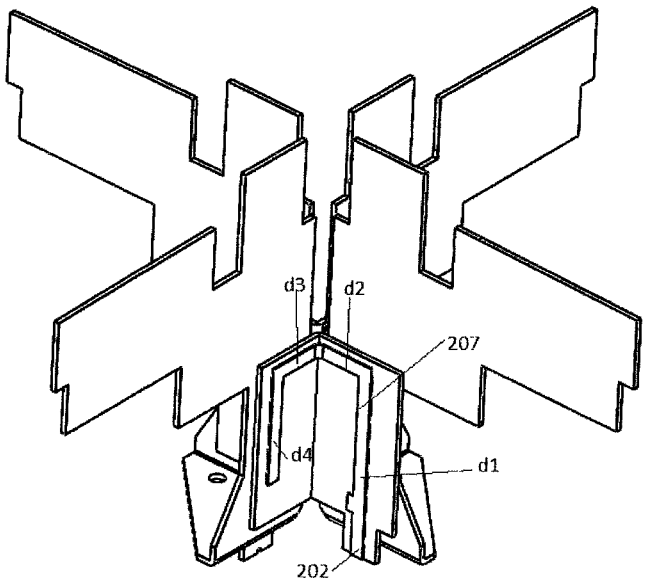
Figure 2-b

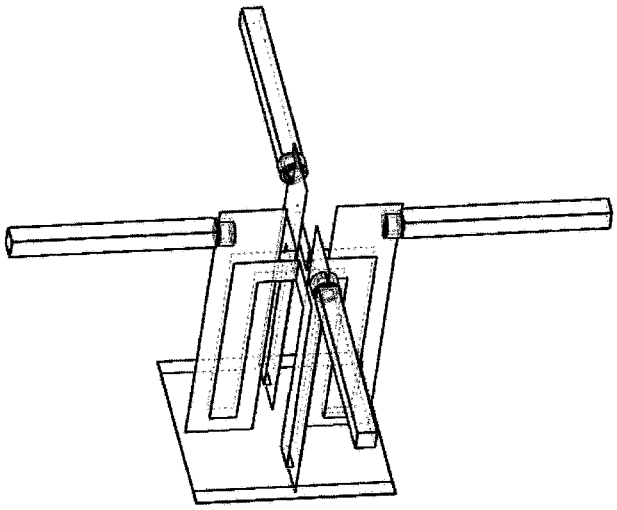
Figure 2-c
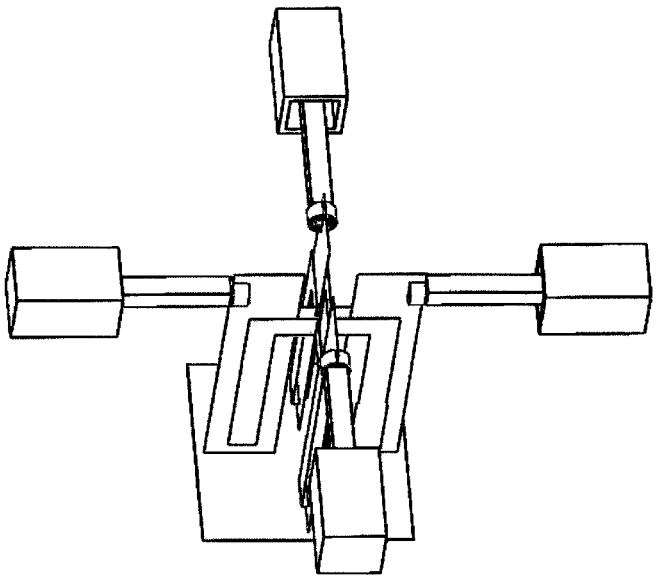
Figure 2-d

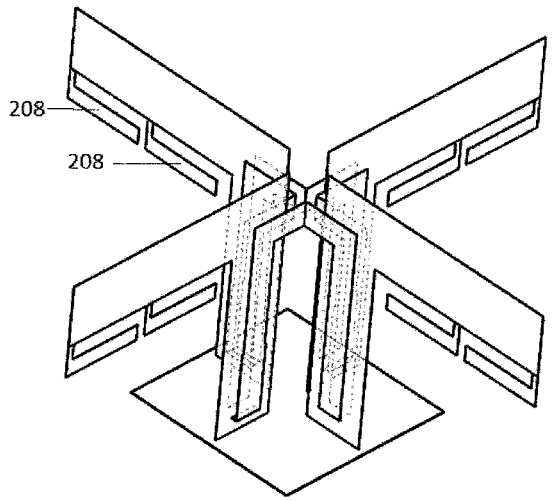
Figure 2-e
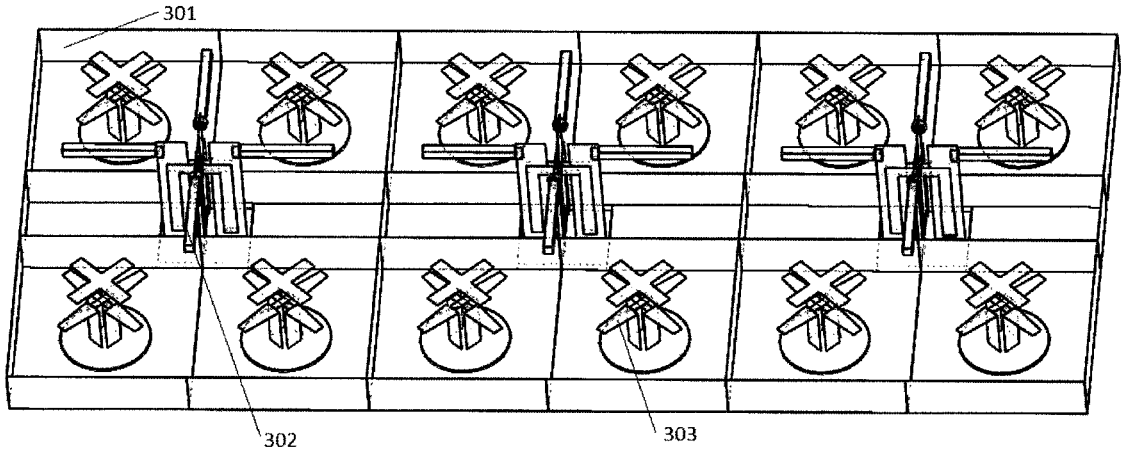
Figure 3-a

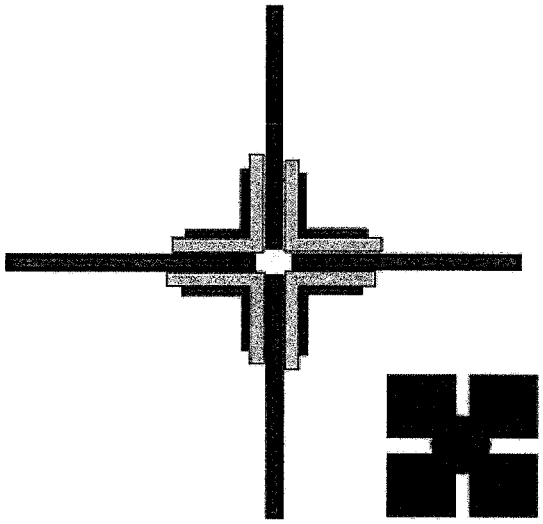
Figure 3-b
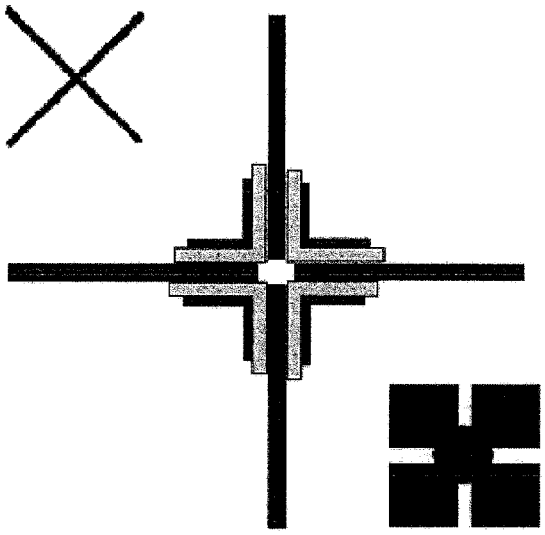
Figure 3-c

LOW BAND DIPOLE AND MULTI-BAND MULTI-PORT ANTENNA ARRANGEMENT

RELATED APPLICATIONS

This Application is a national stage filing under 35 U.S.C. § 371 of International Patent Application Serial No. PCT/CN2016/108408, filed Dec. 2, 2016, which claims priority under 35 U.S.C. § 119(a) and 35 U.S.C. § 365(b) of Chinese patent application number 201510919997.5, filed Dec. 10, 2015.

TECHNICAL FIELD

The present disclosure relates to the field of communication technologies, and in particular, to a low band dipole and a multi-band multi-port antenna arrangement including the low band dipole.

BACKGROUND OF THE INVENTION

Existing multi-band multi-port antenna arrangements are generally arranged in a nested manner, as shown in FIG. 1-*a*. The high band dipole is in the middle of the low band dipole. This kind of arrangement inevitably leads to great mutual coupling between the high- and low-band dipoles, which causes degraded standing wave of the high band dipole placed in the middle of the low band dipole, distorted pattern, and difficult debugging of the isolation indicator. The high band dipole placed at the periphery of the low band dipole is also significantly affected by the low band dipole arm, which has less influence on the standing wave and isolation, and has a greater influence on the pattern; the middle high band dipole also has an effect on the standing wave and isolation of the low band dipole. Usually, it is necessary to simultaneously optimize the low band dipole and the high band dipole in this arrangement, which causes a greatly technical difficulty.

The arrangement shown in FIG. 1-*b* is also often adopted in the existing multi-band multi-port antenna arrangement. This arrangement determines that the dipole arm of the low band dipole must be placed above the high band dipole due to the feeding mode of the low band dipole, so that the decoupling between high and low band dipoles becomes a major problem, the mutual coupling causes a sudden degradation of the pattern of the high- and low-band dipoles in some bands, leading to a sudden deterioration of the antenna performance at these bands, and the pattern of the low band dipole has a wide beam width, failing meet the high performance requirements of the customer.

Therefore, how to solve the problem of reasonable arrangement between high and low band dipoles in a multi-band multi-port antenna arrangement while solving the strong mutual coupling between high and low band dipoles becomes one of the problems that need to be solved by those skilled in the art.

SUMMARY OF THE INVENTION

An object of the present disclosure is to provide a low band dipole and a multi-band multi-port antenna arrangement including the low band dipole.

According to an aspect of the present disclosure, there is provided a low band dipole, wherein the low band dipole has four dipole arms, which are horizontally and mutually perpendicularly placed in a "+" shape, and adjacent two mutually perpendicular dipoles are fed therebetween.

Preferably, the feeding mode comprises at least any one of the following:

coupling feeding;

direct feeding.

Preferably, at least one of the four dipole arms is in a sheet shape.

Preferably, at least one of the four dipole arms is in a columnar shape.

Preferably, at least one of the four dipole arms is a combination of a solid columnar wire and a hollow columnar metal shell, and the cross-sectional area of the hollow columnar metal shell is different from that of the solid columnar wire.

Preferably, a reverse current loop is provided on at least one of the four dipole arms.

Preferably, at least one groove is provided on at least one of the four dipole arms.

According to another aspect of the present disclosure, there is also provided a multi-band multi-port antenna arrangement, wherein the antenna arrangement comprises: a main reflector, at least one column of low band dipole array disposed on the main reflector, and at least one column of high band dipole array adjacent to the at least one column of low band dipole array, wherein each column of the at least one column of the low band dipole array includes at least one low band dipole as described above, wherein the low band dipole and the high band dipole do not shield each other.

Preferably, a high band dipole is disposed on at least one corner of the four dipole arms of the at least one low band dipole, wherein the four dipole arms are horizontally and mutually perpendicularly arranged in a "+" shape.

More preferably, the types of high band dipoles disposed on the at least one corner may be different.

Preferably, the cross-sectional area of the at least one dipole arm in a columnar shape is set according to performance requirement of the antenna.

Preferably, the cross-sectional area of the hollow columnar metal shell and the cross-sectional area of the solid columnar wire are respectively set according to the performance requirement of the antenna.

The present disclosure has the following advantages over the prior art:

The mode of horizontally and mutually perpendicularly arranging the four dipole arms of the low band dipole of the multi-band multi-port antenna arrangement according to the present disclosure in a "+" shape and providing feeding between two adjacent mutually perpendicular dipole to form a +/−45 degree polarization, solves the problem of high and low band dipole arms shielding each other, and helps to reduce mutual coupling between the high and low band dipoles.

Further, the means of providing a reverse current loop on the dipole arm of the low band dipole, changing the shape and cross-sectional area of the dipole arms of the low band dipole, or opening a groove in the dipole arms reduce the mutual coupling between the high and low band dipoles, improve the pattern performance of the antenna arrangement, change bandwidth of the standing wave of the low band dipole, and improve the performance of the antenna arrangement.

DESCRIPTION OF THE DRAWINGS

Other features, objects, and advantages of the present disclosure will become more apparent by reading the following detailed description of non-limiting embodiments with reference to the following drawings:

FIG. 1-*a* shows a schematic structural diagram of a conventional multi-band multi-port antenna arrangement;

FIG. 1-*b* shows a schematic structural diagram of another conventional multi-band multi-port antenna arrangement;

FIG. 2-*a* shows a top view of a low band dipole according to an embodiment of the present disclosure;

FIG. 2-*b* shows a side view of a low band dipole according to an embodiment of the present disclosure;

FIG. 2-*c* shows a low band dipole according to a preferred embodiment of the present disclosure;

FIG. 2-*d* shows a low band dipole according to a preferred embodiment of the present disclosure;

FIG. 2-*e* shows a low band dipole according to a preferred embodiment of the present disclosure;

FIG. 3-*a* shows a schematic structural diagram of a multi-band multi-port antenna arrangement including the low band dipole according to another embodiment of the present disclosure.

FIG. 3-*b* shows a schematic diagram of a high band dipole disposed on one corner of a low band dipole of a multi-band multi-port antenna arrangement according to an embodiment of the present disclosure;

FIG. 3-*c* shows a schematic diagram of two different types of high band dipoles disposed at two corners of a low band dipole of a multi-band multi-port antenna arrangement according to another embodiment of the present disclosure.

The same or similar reference numerals in the drawings denote the same or similar components.

DETAILED DESCRIPTION

Before discussing the exemplary embodiments in more detail, it should be mentioned that the specific structural and functional details disclosed herein are merely illustrative and are for the purpose of describing the exemplary embodiments of the present disclosure. However, the disclosure may be embodied in many alternate forms and should not be construed as limited only to the embodiments set forth herein.

The terminology used herein is for the purpose of describing particular embodiments only and is not intended to limit exemplary embodiments. As used herein, the singular forms "a," "an," and "the" may be intended to include the plural forms as well, unless the context clearly indicates otherwise. It should also be understood that the terms "including" and/or "comprising" as used herein define the presence of stated features, integers, steps, operations, units and/or components without precluding the presence or addition of one or more other features, integers, steps, operations, units, components, and/or combinations thereof.

It should also be mentioned that, in some alternative implementations, the mentioned functions/actions may occur in different orders than those indicated in the figures. For example, depending on the functions/acts involved, the two figures shown one after the other may actually be performed substantially simultaneously or sometimes in reverse order.

Unless otherwise defined, all terms (including technical and scientific terms) used herein have the same meaning as commonly understood by one of ordinary skill in the art to which example embodiments belong. It should also be understood that, unless explicitly defined herein, for example, those terms defined in commonly used dictionaries should be construed as having a meaning consistent with their meaning in the context of the relevant art, and should not be interpreted as idealized or too formal meaning.

The present disclosure will be further described in detail below with reference to the accompanying drawings. It should be noted that the embodiments of the present application and the features of the embodiments can be combined with each other without conflict.

According to an aspect of the present disclosure, there is provided a low band dipole, wherein the low band dipole has four dipole arms, and the four dipole arms are horizontally and mutually perpendicularly arranged in a "+" shape, and adjacent two mutually perpendicular dipoles are fed therebetween.

One of these embodiments is shown in, for example, FIGS. 2-*a*, 2-*b*.

FIG. 2-*a* shows a top view of a low band dipole according to one embodiment of the present disclosure, and FIG. 2-*b* shows a side view of a low band dipole according to an embodiment of the present disclosure. The low band dipole 2 includes four dipole arms 201, which are horizontally and mutually perpendicularly arranged in a "+" shape, and adjacent two mutually perpendicular dipole arms are fed therebetween. As shown in FIG. 2-*b*, the dipole arm 201 is connected to the feed line through the feed point 202 for welding. Particularly, there is a feed point 202 at the same corresponding positions on each of the dipole arms, and adjacent two mutually perpendicular dipole arms are fed so as to form a +/−45 degree-polarized antenna dipole.

Here, the four dipole arms of the low band dipole 2 are horizontally and mutually perpendicularly arranged in a "+" shape, and are structurally similar to the horizontally and vertically polarized antenna dipoles. However, since two adjacent mutually perpendicular dipole arms are fed therebetween, a +/−45 degree-polarized antenna dipole is formed. The combined arrangement of the low band antenna dipole having the above-mentioned structure and a high band dipole having a conventional +/−45 degree-polarized antenna dipole overcomes the problem of mutual shielding between the high and low band dipole arms, and is advantageous in reducing the mutual coupling between the high and low band dipoles.

In particular, the feeding mode between two adjacent mutually perpendicular dipole arms of the low band dipole includes but not limited to:

1) coupling feeding. For example, two adjacent mutually perpendicular dipole arms 201 in the low band dipole 2 are coupling fed. As shown in FIG. 2-*b*, the feed line 207 is welded to the dipole arm 201 through the feed point 202, the feed line 207 is vertically extended upward from the feed point 202 like the feed line section d1 in the FIG. 2-*b*, where there is a right-angled bend in the middle, such as the right-angled bend between the feed line sections d2 and d3 in FIG. 2-*b*. The feed line section d4 is parallel to d1 to achieve the coupling feeding between two adjacent dipole arms, and the field strengths of the four dipole arms are combined and superposed respectively, for example, the field strengths 203 and 204 in FIG. 2-*a* being superimposed and combined and 205 and 206 being superimposed and combined, so as to form a +/−45 degree-polarized antenna dipole.

2) Direct feeding. By directly feeding two adjacent dipole arms, the field strengths of the four dipole arms are combined and superposed, respectively, to form a +/−45 degree-polarized antenna dipole.

Those skilled in the art should understand that, the above-mentioned feeding mode is merely provided as an example, and existing or later possible feeding modes, if applicable to the present disclosure, should be also included within the protection scope of the present disclosure, and are hereby incorporated herein by reference.

Preferably, at least one of the four dipole arms of the low band dipole 2 is in a sheet shape. For example, the dipole arm 201 of the low band dipole 2 shown in FIG. 2-*b* adopts a sheet-shaped structure, and the dipole arms having a sheet-shaped structure are mutually perpendicularly arranged. The sheet-shaped structure adopted by the dipole arms facilitates the arranging of grooves on the dipole arms, the optimizing of the standing wave of the antenna, and the performance such as the pattern and the cross-polarization discrimination, and the use of a sheet-shaped structure provides more convenient processing and designing.

Preferably, at least one of the four dipole arms of the low band dipole 2 is in a columnar shape. In particular, the columnar structure includes, but is not limited to, a cylinder, a polygonal prism and the like, and the polygonal prism includes, but is not limited to, a triangular prism, a tetragonal prism, or a columnar body having a plurality of edges. For example, FIG. 2-*c* shows a low band dipole according to a preferred embodiment of the present disclosure. The four dipole arms 201 of the low band dipole 2 adopt a cylindrical structure, and are horizontally and mutually perpendicularly arranged in a "+" shape, and two adjacent mutually perpendicular dipole arms 201 are fed therebetween.

Here, the width of the standing wave of the low band dipole 2 can be adjusted by changing the cross-sectional area of the columnar structure of the dipole arm 201.

It is should be understood by those skilled in the art that, the structural shape of the above-mentioned dipole arm is merely provided as an example, and the existing or later possible structure shape of the dipole arm, if applicable to the present disclosure, shall be also included in the scope of protection of the present disclosure, and is hereby incorporated by reference.

Preferably, at least one of the four dipole arms of the low band dipole 2 is a combination of a solid columnar wire and a hollow columnar metal shell, in which the cross-sectional area of the hollow columnar metal shell is different from that of the solid columnar wire. For example, FIG. 2-*d* shows a schematic structural view of a low band dipole according to a preferred embodiment of the present disclosure, in which the dipole arm of the low band dipole 2 consists of two parts: a solid wire of a tetragonal prism and a hollow metal shell of a tetragonal prism; and when the cross-sectional area of the hollow columnar metal shell is different from that of the solid columnar wire, preferably, when the cross-sectional area of the hollow columnar metal shell is larger than that of the solid columnar wire, the hollow metal shell can act as a reverse current loop, so as to cancel out the mutual coupling between the high and low bands when being arranged in combination with a high band dipole using a conventional +/−45 degree-polarized antenna dipole.

Here, on the one hand, using the above structure can adjust the bandwidth of the standing wave of the low band dipole 2, and on the other hand, the hollow columnar metal shell can further serve as a reverse current loop for canceling out the mutual coupling between high and low bands.

Those skilled in the art should understand that, the above-mentioned dipole arms of the low band dipole adopting a tetragonal prism is merely provided as an example, and the existing or later-possible structure of the m dipole arm, if applicable to the present disclosure, should also be included in the scope of the present disclosure, and is hereby incorporated by reference herein. In addition, the number of the edges of the columns constituting the dipole arms of the aforementioned low band dipole 2 may be the identical or different. For example, it may be a combination of a solid trigonal prism and a hollow trigonal prism, or the combination of a solid trigonal prism and a hollow tetragonal prism, etc. Other different combinations of columns, if applicable to the present disclosure, should also be included within the scope of the present disclosure, and incorporated herein by reference.

Preferably, a reverse current loop is provided on at least one of the four dipole arms of the low band dipole 2. For example, FIG. 2-*e* shows a schematic structural diagram of a low band dipole according to a preferred embodiment of the present disclosure. As shown in FIG. 2-*e*, two sections of wires 208 extend from the four dipole arms of the low band dipole 2, respectively, and constitutes the reverse current loop of the dipole arms, so as to cancel out the mutual coupling between the high and low bands when being arranged in combination with the high band dipole using a conventional +/−45 degree polarized antenna dipole; as shown in FIG. 2-*d*, the hollow metal shell can serve as a reverse current loop and can also cancel out the mutual coupling between the high and low bands when the low band dipole 2 is arranged in combination with a high band dipole using a conventional +/−45 degree polarized antenna dipole.

Those skilled in the art should understand that the structure of the above-mentioned reverse current loop is merely provided as an example, and existing or later-possible structure of the reverse current loop, if applicable to the present disclosure, shall also be included in the scope of protection of the present disclosure, and is hereby incorporated herein by reference.

Preferably, at least one groove is provided on at least one of the four dipole arms. For example, as shown in FIG. 2-*b*, one groove is respectively arranged on each of the four dipole arms to change the pattern performance of the low band dipole and adjust the cross polarization discrimination ratio of the low band dipole.

Here, in the low band dipole, the effect of changing the pattern performance of the low band dipole and adjusting the cross-polarization discrimination rate of the low band dipole can be achieved by setting the groove, changing the number of grooves or change the shape of the groove.

Those skilled in the art should understand that, the shape or the number of the grooves arranged on the dipole arm is merely provided as an example, and the number of grooves can be set according to the requirements of the performance of the antenna. Existing or later-possible shape of anti-grooves, if applicable to the present disclosure, should also be included within the scope of the present disclosure, and are incorporated herein by reference.

Further, the low band dipole can be used for a directional antenna.

According to another aspect of the present disclosure, there is provided a multi-band multi-port antenna arrangement, wherein the antenna arrangement includes: a main reflector, at least one column of low band dipole array disposed on the main reflector, and at least one column of high band dipole array adjacent to the at least one column of low band dipole array, wherein each column of the at least one column of low band dipole array includes at least one low band dipoles described above, wherein the low band dipoles and the high band dipole do not shield each other.

One of the embodiments is shown in FIG. 3-*a*.

FIG. 3-*a* shows a schematic diagram of a multi-band multi-port antenna arrangement including the above-mentioned low band dipole. The multi-band multi-port antenna arrangement 3 includes: a main reflector 301, one column of low band dipole array 302 disposed on the main reflector 301, and two columns of high band dipole arrays 303 adjacent to the one column of low band dipole array 302, wherein the low band dipole array 302 is composed of three low band dipoles 2, and the low band dipole and the high band dipole do not shield each other. In the multi-band multi-port antenna arrangement 3 shown in FIG. 3-*a*, the high band dipoles in the two columns of high band dipole arrays 303 are placed in a straight line in a horizontal direction and in a straight line in a vertical direction, and the low band dipole array 302 is also placed in a straight line, so that the high band dipole and the low band dipole do not shield each other.

Those skilled in the art should understand that, the structure of the multi-band multi-port antenna arrangement 3 mentioned above is merely provided as an example. The number of low band dipole arrays may be two, three or more columns. Also, the low band dipole array 302 being composed of three low band dipoles 2 is merely provided as an example. Each column of the at least one of low band dipole arrays may include one, two, three or more low band dipoles 2 according to the present disclosure, and is applicable to the present disclosure, as long as it is satisfied that each column of the at least one columns of the low band dipole array includes at least one low band dipole 2 as mentioned above. The number of the high band dipole arrays 303 may also be set according to requirements, and may be one column, two columns, three columns or multiple columns. In addition, the high band dipoles in the two columns of high band dipole arrays 303 are placed in a straight line in the horizontal direction and in a straight line in the vertical direction is also provided as an example. The arrangement of the high band dipoles in the high band dipole array 303 may also adopt an irregular arrangement manner. The arrangement of the low band dipoles in the low band dipole array may also adopt an irregular arrangement manner, which is applicable to the present disclosure and should be included in the present disclosure, as long as it is satisfied that the arrangement of the low band dipole and the high band dipole do not shield each other.

Preferably, a high band dipole is disposed on at least one corner of the four dipole arms of the at least one low band dipole, wherein the four dipole arms are horizontally and mutually perpendicularly arranged in the "+" shape. For example, FIG. 3-*b* shows a schematic diagram of a high band dipole disposed on one corner of a low band dipole of a multi-band multi-port antenna arrangement according to an aspect of the present disclosure. As shown in FIG. 3-*b*, one high band dipole is disposed on one corner of the low band dipole 2.

Those skilled in the art should understand that one high band dipole disposed on one corner of the low band dipole 2 is merely provided as an example, and one high band dipole may be disposed on each of the any two corners of the low band dipole 2, one high band dipole may also be disposed on each of the any three corners of the low band dipole 2, or one high band dipole may also be disposed on each of the four corners of the low band dipole 2, which is applicable to the present disclosure and shall also be included in the protection scope of the present disclosure, as long as it is satisfied that one high band dipole is disposed on at least one corner of the at least one low band dipole 2.

Preferably, the types of the high band dipoles disposed on at least one corner of the at least one low band dipole may be different. For example, the high band dipole may adopt a horizontally-placed sheet-like structure, as shown in FIG. 1-*a*; a vertically-placed sheet-like structure may also be adopted, such as the sheet-like dipole arm of the high band dipole arranged upright by the arrangement way of the sheet-like of the low band dipole in FIG. 1-*b*. Further, different types of dipole arms may be respectively used for the high band dipoles disposed on different corners of the at least one low band dipoles, as shown in FIG. 3-*c*.

Those skilled in the art should understand that the above-mentioned type of the dipole arm of the high band dipole is merely provided as an example, and the existing or later-possible types of the high band dipole arms, if applicable to the present disclosure, shall also be included in the scope of the present disclosure, and is hereby incorporated by reference herein.

Preferably, the cross-sectional area of the at least one dipole arm in a columnar shape is set according to the performance requirement of the antenna. For example, the cross-sectional area of the dipole arm can be set to be relatively small when the user needs a relatively narrow bandwidth of the antenna; the cross-sectional area of the dipole arm can be set to be relatively large when the user needs a relatively wide bandwidth of the antenna; or the dipole arm is constructed by using a combination of multiple cross-sectional areas so as to provide flexible setting according to the performance requirement of the antenna.

Those skilled in the art should understand that the above-mentioned arrangement manner of the dipole arm of the low band dipole is merely provided as an example, and the existing or future possible arrangements of the dipole arms of the low band dipole, if applicable to the present disclosure, shall be included in the scope of the present disclosure, and is hereby incorporated by reference herein.

Preferably, the cross-sectional area of the hollow columnar metal shell and the cross-sectional area of the solid columnar wire are respectively set according to performance requirement of the antenna. In general, a relatively wide cross-sectional area is used to design a wide-band radiating unit. If it is necessary to meet the special requirement of a narrow-band, a finer cross-sectional area may be considered.

Herein, the four dipole arms of the low band dipole of the multi-band multi-port antenna arrangement are arranged horizontally and mutually perpendicularly in a "+" shape, and adjacent two mutually perpendicular dipole arms are fed therebetween to form a +/−45 degrees polarization, which solves the problem of high and low band dipole arm shielding each other, and helps to reduce the mutual coupling between high and low band dipoles.

Preferably, the means of providing a reverse current loop to the dipole arm of the low band dipole, changing the shape and cross-sectional area of the dipole arms of the low band dipole, or opening a groove in the dipole arms reduce the mutual coupling between the high and low band dipoles, improve the pattern performance of the antenna arrangement, change bandwidth of the standing wave of the low band dipoles, and improve the performance of the antenna arrangement.

For a person skilled in the art, it is apparent that the present disclosure is not limited to the details of the above exemplary embodiments, and the present disclosure can be implemented in other specific forms without departing from the spirit or essential characteristics of the present disclosure. Therefore, the embodiments should be in any way regarded as exemplarily and not restrictive, and the scope of the present disclosure is defined by the appended claims rather than the above description, and therefore it is intended that the claims all changes that come within the meaning and range of equivalency of the disclosure are encompassed by the disclosure. Any reference signs in the claims should not be regarded as limiting the involved claims. In addition, it is clear that the word "comprising" does not exclude other units or steps, and the singular does not exclude the plural. The multiple units or arrangements recited in the system claims may also be implemented by one unit or arrangement through software or hardware. First, second, etc. words are used to indicate names and do not indicate any specific order.

The invention claimed is:

1. A low band dipole, comprising:

four dipole arms, wherein the four dipole arms are horizontally and mutually perpendicularly placed in a non-planar "+" shape in vertical view, wherein adjacent mutually perpendicular dipole arms of the four dipole arms are fed therebetween, wherein at least one of the four dipole arms is a combination of a solid columnar wire and a hollow columnar metal shell, wherein a cross-sectional area of the hollow columnar metal shell is different from a cross-sectional area of the solid columnar wire.

2. The low band dipole according to claim 1, wherein a feeding mode between the adjacent mutually perpendicular dipole arms comprises coupling feeding.

3. The low band dipole according to claim 1, wherein at least one of the four dipole arms is in a sheet shape.

4. The low band dipole according to claim 1, wherein at least one of the four dipole arms is in a columnar shape.

5. The low band dipole according to claim 1, wherein a reverse current loop is provided on at least one of the four dipole arms.

6. The low band dipole according to claim 1, wherein at least one groove is provided on at least one of the four dipole arms.

7. A multi-band multi-port antenna arrangement, comprising:

a main reflector, at least one column of low band dipole array disposed on the main reflector, and at least one column of high band dipole array adjacent to the at least one column of low band dipole array, wherein each column of the at least one column of low band dipole array includes at least one low band dipole according to claim 1, wherein the at least one low band dipole and a high band dipole do not shield each other.

8. The multi-band multi-port antenna arrangement according to claim 7, wherein a high band dipole is disposed on at least one corner of the four dipole arms of at least a first of the at least one low band dipole, wherein the four dipole arms are horizontally and mutually perpendicularly arranged in the non-planar "+" shape.

9. The multi-band multi-port antenna arrangement according to claim 8, wherein the types of high band dipoles disposed on the at least one corner may be different.

10. The multi-band multi-port antenna arrangement according to claim 7, wherein the cross-sectional area of the hollow columnar metal shell is set according to a performance requirement of the multi-band multi-port antenna.

11. The multi-band multi-port antenna arrangement according to claim 7, wherein the cross-sectional area of the hollow columnar metal shell and the cross-sectional area of the solid columnar wire are respectively set according to a performance requirement of the multi-band multi-port antenna arrangement.

12. The low band dipole according to claim 1, wherein the adjacent mutually perpendicular dipole arms are fed such that a +/−45 degree-polarized antenna dipole is formed.

13. The low band dipole according to claim 1, wherein a feeding mode between the adjacent mutually perpendicular dipole arms comprises direct feeding.

14. A low band dipole, comprising:

four dipole arms, wherein the four dipole arms are horizontally and mutually perpendicularly placed in a non-planar "+" shape, wherein adjacent mutually perpendicular dipole arms of the four dipole arms are fed therebetween, wherein each of the four dipole arms comprises a sheet shape part and a columnar shape part, wherein the sheet shape parts of the four dipole arms are horizontally and mutually perpendicularly placed in the non-planar "+" shape in vertical view.

15. The low band dipole according to claim 14, wherein the columnar shape part includes at least one of a cylinder, a polygonal prism, a triangular prism, a tetragonal prism, and a columnar body having a plurality of edges.

* * * * *